US007563081B2

(12) United States Patent
Yoda et al.

(10) Patent No.: US 7,563,081 B2
(45) Date of Patent: Jul. 21, 2009

(54) GAS COMPRESSOR

(75) Inventors: Seiichiro Yoda, Ichikawa (JP); Yongwei Shi, Chiba (JP)

(73) Assignee: Calsonic Compressor Inc., Narashino-shi (JP)

( * ) Notice: Subject to any disclaimer, the term of this patent is extended or adjusted under 35 U.S.C. 154(b) by 448 days.

(21) Appl. No.: 11/159,368

(22) Filed: Jun. 23, 2005

(65) Prior Publication Data

US 2005/0287019 A1 Dec. 29, 2005

(30) Foreign Application Priority Data

Jun. 25, 2004 (JP) ..... 2004-188155

(51) Int. Cl.
*F04B 17/03* (2006.01)
*F01C 1/00* (2006.01)

(52) U.S. Cl. ..... 417/410.3; 418/259; 418/268

(58) Field of Classification Search ..... 417/410.3, 417/421, 310, 220; 418/259–269
See application file for complete search history.

(56) References Cited

U.S. PATENT DOCUMENTS 1,884,702 A * 10/1932 Hubacker ..... 417/294
2,152,056 A * 3/1939 Kenney et al. ..... 417/372
2,246,276 A * 6/1941 Davidson ..... 417/372
2,724,339 A * 11/1955 O'Connor et al. ..... 417/220
3,295,752 A * 1/1967 Bellmer ..... 417/304
3,381,891 A 5/1968 Bellmer
4,097,204 A * 6/1978 Palmer ..... 418/19
4,507,065 A 3/1985 Shibuya et al.
5,083,909 A * 1/1992 Kunsemiller et al. ..... 418/102
6,913,448 B2 * 7/2005 Liang et al. ..... 417/410.5
2001/0016167 A1 * 8/2001 Sundberg et al. ..... 417/220

FOREIGN PATENT DOCUMENTS

JP 2003-254244 A 9/2003
JP 2004-300937 A 10/2004

* cited by examiner

*Primary Examiner*—Charles G Freay
(74) *Attorney, Agent, or Firm*—Foley & Lardner LLP

(57) ABSTRACT

A gas compressor includes a housing with suction and discharge ports, and a gas-compressing mechanism housed in the housing to compress a gas sucked through the suction port and discharge the compressed gas via the discharge port. The mechanism includes a cylinder defining a cylinder chamber with a circular or elliptical cross-sectional shape. The cylinder has a suction inlet and a discharge outlet. The suction inlet and the discharge outlet are opened in a peripheral wall of the cylinder chamber. A suction passage is formed along an outer periphery of the cylinder corresponding to a peripheral direction of the cylinder chamber. A discharge passage extends inside a thick portion of the cylinder along a center axis of the cylinder chamber. The suction inlet communicates with the suction port via the suction passage. The discharge outlet communicates with the discharge port via the discharge passage.

7 Claims, 4 Drawing Sheets

Prior Art

GAS COMPRESSOR

BACKGROUND OF THE INVENTION

1. Field of the Invention

The present invention relates to a gas compressor which is to be favorably assembled into a refrigerating machine or an air conditioner as a refrigerant compressor. Particularly, the invention favorably relates to a motor-driven gas compressor into which an electric motor is assembled as a driving source for a gas-compressing mechanism.

2. Related Art Statement

Heretofore, a vane rotary type gas compressor is used as the gas compressor of this type (For example, see JP-A 2003-254244). As shown in FIG. 4, a compressing mechanism 3 is housed in a housing 2 of such a vane rotary type gas compressor 1. The housing 2 is provided with a suction port and a discharge port not shown. The compressing mechanism 3 has a cylinder 4 and a rotor 5 rotatably housed in the cylinder. The cylinder 4 defines a cylinder chamber 6 having an elliptical cross-sectional shape. In the cylinder chamber 6, the rotor 5 is provided with vanes 7 which divide the cylinder chamber 6 into a plurality of compressing chambers 6*a* in a circumferential direction. The volume of each of the compressing chambers 6*a* increases or decreases with the rotation of the rotor 5.

When the volume of the compressing chamber 6*a* increases with the rotation of the rotor 5, a refrigerant is sucked into a suction chamber (not shown) inside the housing 2 through the suction port, and further is sucked from this suction chamber into the compression chamber 6*a* via a suction passage (not shown) extending in the cylinder 4 and a suction inlet 8 opened to the cylinder chamber 6. On the other hand, when the volume of the compressing chamber 6*a* decreases with the rotation of the rotor 5, the refrigerant inside the compression chamber is compressed. The compressed refrigerant is guided, via the discharge outlet 9 opened to the cylinder chamber 6, to a discharge space 9*a* formed by a cut portion defined between the cylinder 4 and the housing surrounding the cylinder 2, into the discharge port communicating with the discharge space. In the discharge space 9*a* is provided a check valve mechanism 9*b* for preventing the compressed refrigerant from flowing back into the compressing chamber 6*a*.

Although not shown, an electric motor is arranged as a driving force for the rotor inside the suction chamber in communication with the suction port of the housing so that the motor may be cooled with the refrigerant flowing in the housing. The actuation of the electric motor operates the gas-compressing mechanism, the refrigerant is sucked into the gas compressor via the suction port of the housing from a compressor (not shown) as mentioned above, and the refrigerant compressed by the gas compressor is fed to a condenser through the discharge port formed in the housing under pressure.

In the conventional gas compressor, the suction inlet 8 is opened at an end wall of the cylinder chamber 6 for taking the refrigerant into the cylinder chamber 6, and the refrigerant is sucked from the suction passage into the compressing chamber 6*a* through the suction inlet 8 opened at the end face of the cylinder chamber 6. On the other hand, the refrigerant compressed in the compressing chamber 6*a* is discharged into the discharge space 9 formed between the cylinder 4 and the housing 2 covering the cylinder, through the discharge outlet 9*a* opened in the peripheral wall of the cylinder chamber 6. Therefore, the high pressure of the compressed refrigerant acts as an internal pressure upon a portion of the housing 2 covering the outer peripheral portion of the cylinder of the housing. Consequently, in order to withstand such a high pressure, the housing 2 is made thick, so that the increased thickness may cause the larger dimension and increased weight of the housing.

Further, according to the conventional structure in which the discharge pressure acts upon the outer peripheral portion of the cylinder, it was not easy to assuredly prevent internal leakage from occurring due to the leakage of the high pressure at the outer peripheral portion of the cylinder toward a low-pressure side such as the suction passage.

SUMMARY OF THE INVENTION

Under the circumstances, it is an object of the present invention to provide a gas compressor which can make a housing more compact without increasing the weight of the housing and more easily prevent internal leakage as compared with the conventional gas compressor.

A prior patent application No. 2003-91540 (JP-A 2004-300937) in the name of Calsonic Compressor proposed a construction in which a discharge outlet is opened in a peripheral wall of a cylinder chamber for permitting refrigerant to be discharged from a compressing chamber of a cylinder, a discharge passage is formed in a cylinder member, penetrated from one end to the other thereof without forming a discharge space by a cut portion at an outer periphery of the cylinder, a refrigerant is led from the discharge outlet to a discharge port via the discharge passage, and thereby the pressure of the compressed refrigerant from the discharge outlet will not be applied to a housing at the outer periphery of the cylinder.

The present invention utilizes a part of such a structure, and is directed to a gas compressor comprising a housing formed with a suction port and a discharge port, and a gas-compressing mechanism housed in the housing and adapted to compress a gas sucked through the suction port and discharge the compressed gas through the discharge port, said gas-compressing mechanism comprising a cylinder, said cylinder defining a cylinder chamber having a circular or elliptical cross-sectional shape, said cylinder being provided with a suction inlet for sucking a gas to be compressed into the cylinder chamber and a discharge outlet adapted for discharging the compressed gas from the cylinder chamber, said suction inlet and said discharge outlet being opened in a peripheral wall of the cylinder chamber, a suction passage being formed along an outer periphery of the cylinder corresponding to a peripheral direction of the cylinder chamber, a discharge passage extending inside a thick portion of the cylinder along a center axis of the cylinder chamber, said suction inlet communicating with the suction port via the suction passage, said discharge outlet communicating with a peripheral wall of the discharge passage and communicating with the discharge port via the discharge passage.

According to the gas compressor of the present invention, both of the suction inlet for sucking the refrigerant into the cylinder chamber and the discharge outlet for discharging the refrigerant from the cylinder chamber are opened in the peripheral wall of the cylinder chamber, and the gas sucked through the suction port is guided to the suction inlet through the suction passage formed along the peripheral wall of the cylinder, and the compressed gas discharged from the discharge outlet is guided to the discharge port through the discharge passage.

The discharge passage receiving the compressed gas discharged through the discharge outlet is not opened to the outer periphery of the cylinder, but is formed in the thick portion of the cylinder along with a center axis of the cylinder chamber.

Accordingly, the pressure of the refrigerant compressed in the compressing chamber does not act as an internal pressure directly upon that portion of the housing as covering the outer periphery of the cylinder. Therefore, that portion of the housing as covering the outer periphery of the cylinder can be relatively strengthened without increasing the thickness of this portion.

Further, since the refrigerant to be compressed is guided into the compressing chamber from the suction chamber through the suction inlet opened in the peripheral wall of the cylinder via the suction passage formed along the outer periphery of the cylinder, the low-pressure path including the suction passage can be relatively easily and assuredly separated from the high-pressure path including the discharge passage. Thus, the internal leakage of the compressed refrigerant can be assuredly prevented by the relatively simple construction.

The present invention can be utilized for a vane rotary type gas-compressing mechanism comprising a cylinder, a rotor rotatably arranged inside a cylinder chamber of the cylinder and having a plurality of vanes, said plurality of the vanes being adapted for dividing the cylinder chamber into a plurality of compressing chambers in a peripheral direction of the cylindrical chamber, and a volume of each of the compressing chambers increasing or decreasing with rotation of the rotor.

The cylinder may be constructed by a cylinder member having opposite ends opened and adapted to define a hollow space for said cylinder chamber, and end wall members closing the opposite ends of the cylinder member, respectively, a suction inlet and a discharge outlet are formed in the cylinder member such that the suction inlet and the discharge outlet are opened in an peripheral wall of the cylinder member, said suction passage is formed along an outer periphery of the cylinder member, and said discharge outlet extends inside a thick portion of the cylinder member from one end to the other of the cylinder member.

The suction passage may be constructed by a first passage portion extending from a suction chamber communicating with the suction port to under the cylinder member and a second annular passage portion defined by a recessed groove along the outer peripheral face, connected with the first passage portion and communicating with the suction inlet.

In the gas compressor, an electric motor may be arranged in the suction chamber and adapted to drive the compressing mechanism. Such a gas compressor may be called "motor-driven gas compressor".

Since the rotor can be rotated at a higher speed in the motor-driven gas compressor as compared with the gas compressor in which the rotor is rotated by rotary force of an engine mounted in a vehicle, the invention is more advantageous for a $CO_2$ gas compressor which requires higher pressure refrigerant as compared with R134a. The present invention is also advantageous in miniaturization and weight reduction of the gas compressor using such a high-pressure refrigerant.

As mentioned above, according to the motor-driven gas compressor of the present invention, since the refrigerant sucked through the suction port is guided into the cylinder chamber via the suction passage formed along the outer periphery of the cylinder and the suction inlet opened in the peripheral wall of the cylinder, whereas the refrigerant compressed in the cylinder chamber is guided to the discharge port via the discharge outlet opened in the peripheral wall of the cylinder and the discharge passage extending in the thick portion of the cylinder along the central axis of the cylinder chamber.

Therefore, according to the present invention, high discharge pressure is prevented from acting as the internal pressure upon the housing at the outer periphery of the cylinder, and the internal leakage of the compressed gas from the high-pressure side to the low-pressure side can be assuredly prevented. Therefore, the housing can be made compact without causing increased weight of the housing and the internal leakage can be assuredly prevented.

The disclosure of Japanese patent application No. 2004-188155 filed on Jun. 25, 2004 of which convention priority is claimed in the present patent application is incorporated herein by reference in its entirety.

BRIEF DESCRIPTION ON THE DRAWINGS

For a better understanding of the invention, reference is made to the attached drawings, wherein.

DETAILED EXPLANATION OF A PREFERRED EMBODIMENT OF THE INVENTION

Figure 1:
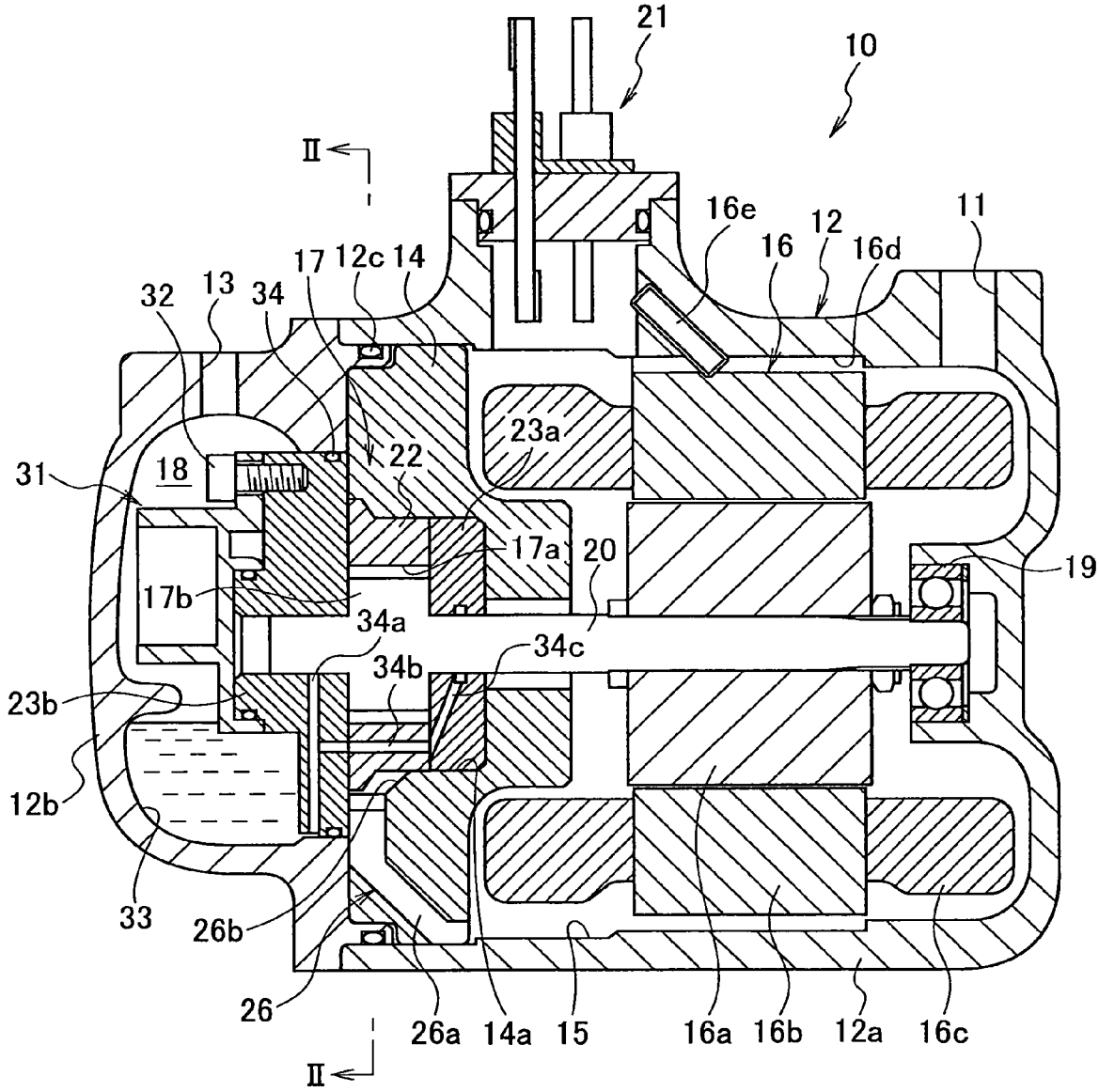
FIG. 1 is a vertical cross sectional view of a gas compressor according to the present invention.

In the following, the present invention will be explained along with an embodiment shown in the drawings.

The gas compressor according to the present invention is to be applied to an air conditioner mounted on an automobile, for example. This gas compressor forms a refrigerant-circulating path for cooling cycles together with a condenser, an expansion valve, an evaporator, etc. conventionally well known as the constituent elements of the air conditioner.

In the embodiment shown in FIG. 1, the gas compressor 10 according to the present invention comprises a two-split type housing 12 composed of a cylindrical front housing member 12*a* having one end opened and a cylindrical rear housing member 12*b* closing the opened one end of the front housing member 12*a*. The housing members 12*a* and 12*b* are assembled together in a cylindrical form as a whole. The front housing member 12*a* is formed with a suction port 11 to be connected to the evaporator (not shown). The rear housing member is formed with a discharge port 13 to be connected to the condenser (not shown). Both the housing members 12*a* and 12*b* are gas-tightly joined together via a cylindrical sealing member 12*c*.

A partition wall member 14 is arranged at the open end of the front housing member 12*a* to divide the interior of the housing 12 in a direction of a central axis thereof. The partition wall member 14 defines a suction chamber 15 in the housing member 12 on a side of the front housing member 12*a* upstream of the partition wall member 14. The suction chamber communicates with the suction port 11. An electric motor 16 is arranged inside the suction chamber 15. In addition, a gas-compressing mechanism 17 is arranged, inside the housing 12, in a portion of the partition wall member 14 and in a side of the rear housing member 12*b* downstream of the partition wall member 14. Inside the rear housing member 12*b* is defined a high-pressure chamber 18 communicating with the discharge port 13.

In the illustrated embodiment, the electric motor 16 is a conventionally very popular multi-phase brushless DC motor. The motor 16 includes a rotor 16*a* and a stator 16*b* arranged around the rotor and fixed to the front housing member 12*a*. The rotor 16*a* is fixed to a rotary shaft 20, which is rotatably supported, in coincidence with a center axis of the housing 12, by a bearing 19 formed in the front housing member 12*a*. As is conventionally well known, the rotary shaft 20 is rotated in one direction through a magnetically mutual interaction between a permanent magnet (not shown) buried in the rotor 16*a* of the electric motor 16 and a magnetic field generated with multi-phase pulse currents fed to wires 16*c* wound around stator elements of the stator 16*b*. An electric connector 21 is provided at the front housing member 12*a* to feed electricity upon the wirings 16*c* wound around the stator elements.

In the illustrated embodiment, a refrigerant passage 16*d* is formed between the stator 16*b* and a peripheral wall of the front housing member 12*a* so that the refrigerant may flow smoothly from the suction port 11 to the partition wall member 14. The stator 16*b* is assuredly located at a specified position inside the front housing member 12*a* by means of a slant pin 16*e*.

The rotary shaft 20 penetrates into the gas-compressing mechanism 17 through the partition wall member 14 along the center axis of the housing 12.

The gas-compressing mechanism 17 is a conventionally well known vane-rotary type gas-compressing mechanism, for example. The vane-rotary type gas-compressing mechanism 17 includes a cylinder member 22 and opposite side blocks: a front-side block 23*a* and a rear-side block 23*b*. The cylinder member 22 defines an elliptical-section hollow space having opposite ends opened. The front-side and rear-side blocks 23*a* and 23*b* close the opposite ends of the cylinder member, respectively.

The partition wall member 14 is formed with a recessed portion 14*a* on one-side face opposing to the high-pressure chamber 18. The cylinder member 22 and the front-side block 23*a* of the gas-compressing mechanism 17 are received in the recessed portion 14*a* such that a joint interface between the cylinder member 22 and the rear-side block 23*b* is in coincidence with the above one-side face where the recessed portion of the partition wall member 14 is opened.

Figure 2:
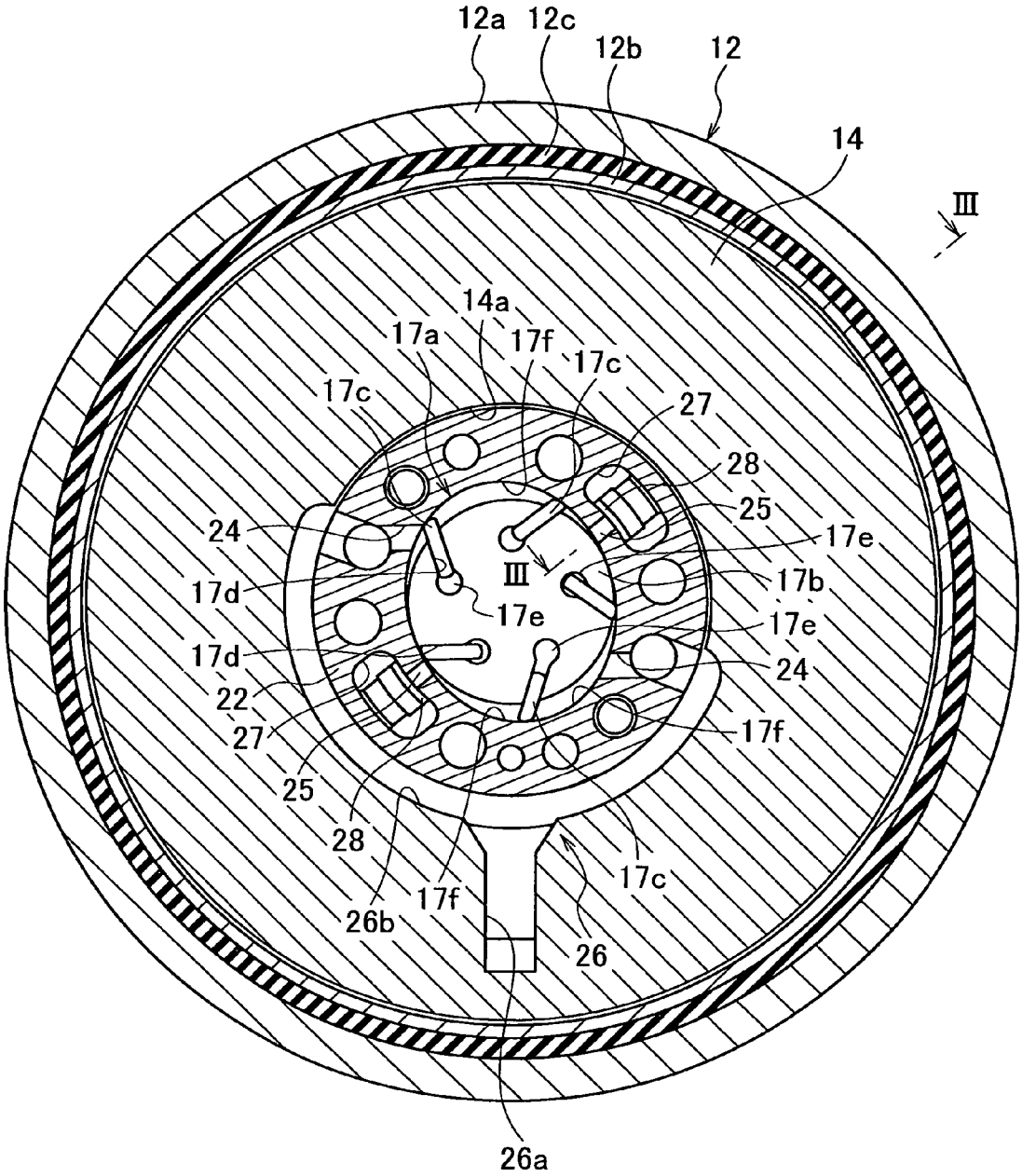
FIG. 2 is a sectional view of FIG. 1 taken along a line II-II.

A cylinder chamber 17*a* having an elliptical cross sectional shape as shown in FIG. 2 is defined by the cylinder member 22 and the opposite side blocks 23*a* and 23*b*. Inside the cylinder chamber 17*a* is rotatably arranged a rotor 17*b* integrally formed with the rotary shaft 20. The rotor 17*b* is formed with vane channels 17*d* in which vanes 17*c* are received movably to-and-fro. As is well known, the vane 17*c* in the vane channel 17*d* is pressed toward the peripheral wall of the cylinder chamber 17*a* with an oil hydraulic pressure fed to a back-pressure chamber 17*e*. The vanes 17*c* divide the cylinder chamber 17*a* into five compressing chambers 17*f* in the circumferential direction thereof.

When the rotor 17*b* rotates integrally with the rotary shaft 20 in coincidence with the center axis of the cylinder chamber 17*a*, the vanes 17*c* of the rotor 17*b* slide on the peripheral wall of the cylinder chamber 17*a*. As is well known conventionally, the volume of each of the compressing chambers 17*f* defined by the vanes 17*c* increases or decreases when the vanes 17*c* slide.

Suction inlets 24 and discharge outlets 25 are formed in the cylinder member 22. As the volume of the compressing chamber 17*f* increases or decreases, the refrigerant gas such as carbon dioxide, for example, is sucked into the compressing chamber 17*f* via the suction inlets, whereas the refrigerant gas is discharged from the compressing chamber through the discharge outlets 25.

The suction inlets 24 are arranged radially of the cylinder chamber 17*a* on opposite sides of minor-axes, respectively, at such positions as biased in a rotary direction of the rotor 17*b* (clockwise in FIG. 2) from the respective minor axes. The discharge outlets are arranged radially of the cylinder chamber on opposite sides of minor-axes, respectively, at such positions as biased in a direction opposite to the rotary direction of the rotor 17*b* (counterclockwise in FIG. 2) from the respective minor axes. One end of each of a pair of the suction inlets 24 and one end of a pair of the discharge outlets 25 are opened into the cylinder chamber 17*a* through its peripheral wall.

Each of a pair of the suction inlets 24 is opened to the outer peripheral face of the cylinder member 22 at the other end thereof. As shown in FIG. 2, said other end communicates with the suction chamber 15 through the suction passage 26 (See FIG. 1). As shown in FIGS. 1 and 2, each suction inlet 24 communicates with the suction port 11 through the suction chamber 15.

As shown in FIGS. 1 and 2, the suction passage 26 includes a first passage portion 26*a* which is formed in a lower portion located under the recessed portion 14*a* of the partition wall member 14 and a second passage portion 26*b* which comprises a recessed groove formed in a semicircular shape along the peripheral wall of the recessed portion 14*a* of the partition wall portion 14. On end of the first passage portion 26*a* is opened to that other face of the partition wall portion 14 which is located on a side of the suction chamber 15, and the other end is opened to a peripheral wall of the recessed groove 26*b*. The second passage portion 26*b* is defined by the recessed groove (26*b*) and the outer peripheral wall of the cylinder member 22 closing the open portion of the groove. The second passage portion 26*b* extends in a semicircular shape along the outer periphery of the cylinder member. Opposite ends of the second passage portion 26*b* are connected to the other ends of the suction inlets 24, respectively. Therefore, the suction passage 26 communicates the bottom portion of the suction chamber 15 with each of the suction inlets 24 through the interior of the partition wall portion 14 and the outer periphery of the cylinder member 22.

Figure 3:
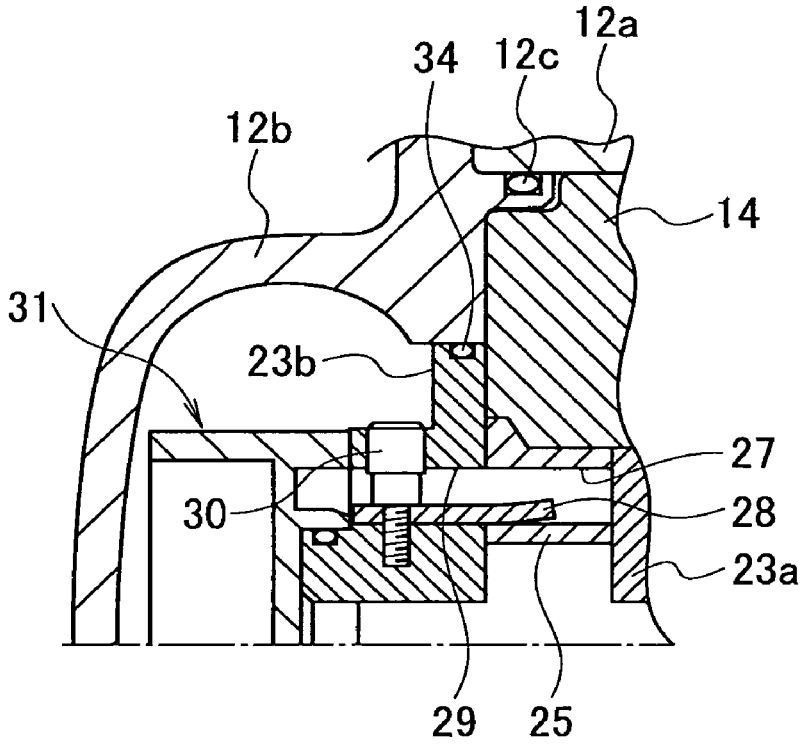
FIG. 3 is a sectional view of FIG. 2 taken along a line III-III.
Figure 4:
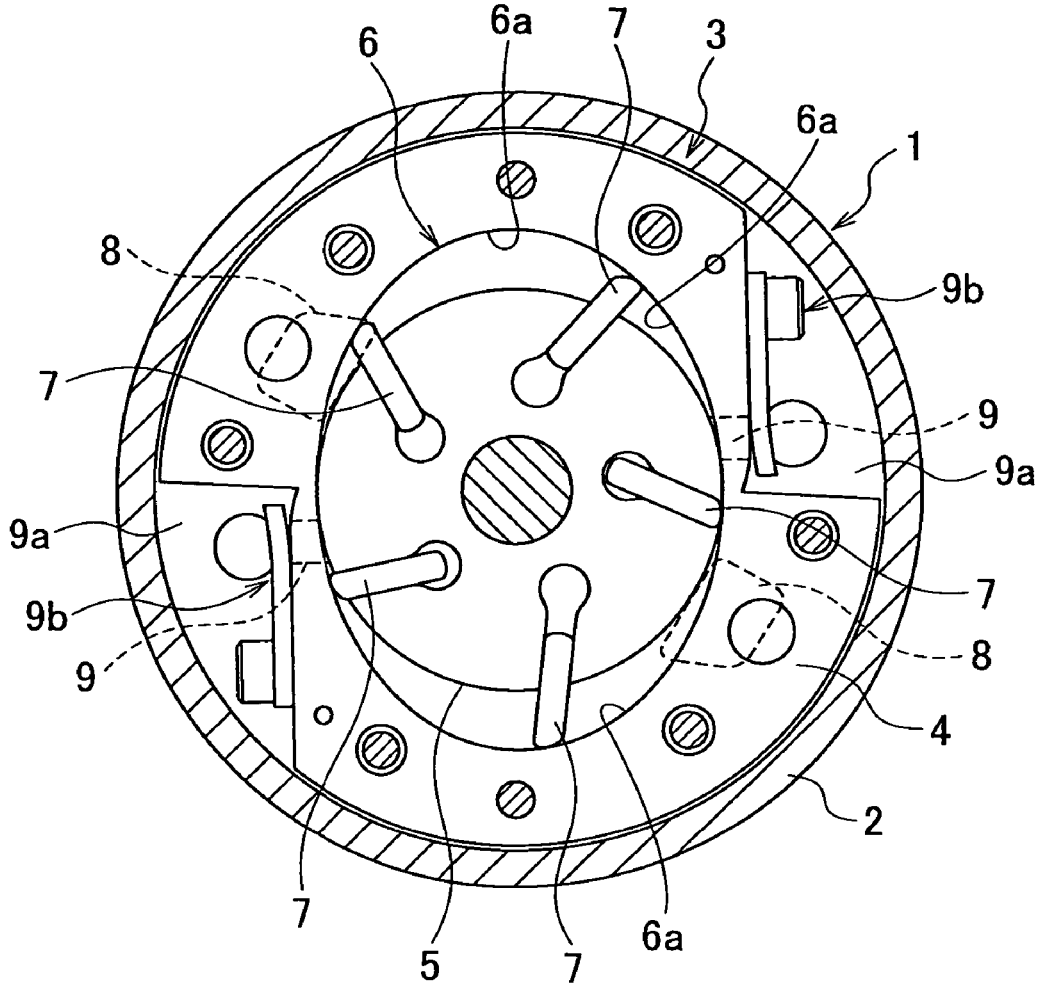
FIG. 4 is a transverse cross sectional view of the conventional gas compressor.

As shown in FIG. 2, the discharge outlet 25 is opened to the peripheral wall of the discharge passage 27 formed in the cylinder member 22 in connection with the discharge outlet 25. The discharge passage 27 has a rectangular cross-sectional shape as a whole, and a check valve 28 is arranged in the discharge passage to open or close the discharge outlet 25. As shown in FIG. 3, the discharge passage 27 is formed penetrating through a thick portion of the cylinder member 22 from one end to the other end along the center axis of the cylinder chamber 17*a*. The rear-side block 23*b* is formed with a passage 29 in coincidence with the discharge passage 27. The check valve 28 opens or closes the discharge outlet 25 opened to the peripheral wall of the discharge passage 27, and extends from the discharge passage 27 to the passage 29. A base portion of the check valve is fixed to the rear-side block 23*b* with a screw member 30. The check valve 28 prevents the refrigerant discharged from the compressing chamber 17*f* to the discharge passage 27 from flowing back to the compressing chamber 17*f*.

The discharge passage 27 is sealed with the front-side block 23*a* at an end portion opposite to the passage 29. As shown in FIG. 1, the discharge passage 27 communicates with an oil separator 31 arranged in the high-pressure chamber 18 via the passage 29. The oil separator 31 is fixed to the rear-side block 23*b* with a screw member 32, and as conventionally well known, the oil separator separates a lubricant contained in the refrigerant passing it from the refrigerant. An oil reservoir 33 is formed in a lower portion of the high-pressure chamber 18 to store the lubricant separated by the oil separator 31. As is conventionally well known, the lubricant inside the oil reservoir 33 is fed to a bearing portion of the cylinder receiving the rotary shaft 20 by the pressure of the refrigerant acting in the high-pressure chamber 18 via lubricant feed passages 34*a*, 34*b* and 34*c* formed in the rear-side block 23*b*, the cylinder member 22 and the front-side block 23*a*, respectively, which constitute the cylinder, whereas that lubricant is also fed to the back pressure chambers 17*e* as a back pressure for the vanes by the above refrigerant pressure.

An annular seal member 34 is arranged in the rear-side block 23*b* to enhance gas tightness in the high-pressure chamber 18 between the rear housing member 12*b* and the rear-side block. The annular sealing member 34 assuredly prevents the high pressure inside the high-pressure chamber 18 from leaking to a low-pressure passage such as the second passage portion 26*b* of the suction passage 26 formed at the outer periphery of the cylinder member 22.

According to the gas compressor 10 of the present invention, when the rotor 17*b* of the gas-compressing mechanism 17 is rotated by actuating the electric motor 16, the volume of the compressing chamber 17*f* to which the suction inlet 24 of the gas-compressing mechanism is opened increases. Consequently, suction force acts in the compressing chamber, and the refrigerant gas containing the lubricant is sucked into the suction chamber 15 through the suction port 11 by the function of the suction force. This refrigerant gas is sucked into the compressing chamber 17*f* through the suction inlet 24 opening in the peripheral wall of the cylinder chamber 17*a* of the gas-compressing mechanism 17 via the suction passage 26 formed at the outer periphery of the cylinder member 22, while cooling the electric motor 16 in the suction chamber 15.

When the volume of the compressing chamber 17*f* decreases as the rotor 17*b* continues to rotate, the refrigerant gas sucked into the compressing chamber 17*f* is compressed. Then, the refrigerant gas compressed inside the compressing chamber 17*f* is discharged via the discharge outlet 25 of the peripheral wall of the cylinder chamber 17*a* to the discharge passage 27 to which the discharge outlet is opened. The refrigerant gas discharged into the discharge passage 27 is blown out to an opposed wall face of the discharge passage 27 at a high pressure corresponding to a compressed rate. Since the discharge passage is not opened to the outer peripheral face of the cylinder member 22, the aforementioned discharge pressure from the discharge outlet 25 does not act upon a peripheral face of the recessed portion 14*a* of the partition wall member 14 surrounding the outer periphery of the cylinder member 22 or a site of the housing 12 surrounding the partition wall member 14. According to the gas compressor 10 of the present invention, merely an extremely low pressure of the refrigerant gas acts between the outer peripheral face of the cylinder member 22 and the partition wall member 14 surrounding this outer peripheral face, as compared with the discharge pressure of the gas flowing in the second passage portion 26*a* of the suction passage 26 before compression.

Therefore, no high pressure acts upon the partition wall member 14 surrounding the cylinder member 22 and such a site of the housing 12 as located at the outer peripheral portion of the cylinder member 22 unlike the conventional gas compressor. Thus, it is considered that strength of these portions is relatively enhanced without increasing the thicknesses of corresponding portions of the partition wall portion 14 and the housing 12.

The refrigerant discharged into the discharge passage 27 is led via the passage 29 to the oil separator 31 where the lubricant is separated. Further, the refrigerant, from which a pressure pulsating component is removed in the high-pressure chamber 18, is led to the condenser through the discharge port 13.

According to the gas compressor 10 of the present invention, as mentioned above, both the suction inlets 24 for sucking the refrigerant into the cylinder chamber 17*a* or the compressing chambers 17*f* of the cylinder chamber 17*a* and the discharge outlets 25 for discharging the refrigerant from the cylinder chamber 17*a* are opened in the peripheral wall of the cylinder chamber 17*a*, and the gas sucked through the suction port 11 is guided to the suction inlet 24 via the suction passages 26 formed along the peripheral wall of the cylinder member 22 constituting the cylinder (22, 23*a* and 23*b*). Further, the compressed gas discharged from the discharge outlet 25 is guided to the discharge port 13 via the discharge passage 27.

The discharge passage 27 for receiving the compressed gas from the discharge outlet 25 is formed in the thick portion of the cylinder member along the center axis of the cylinder chamber 17*a* without being opened to the outer peripheral portion of the cylinder member 22 of the cylinder. Thus, the pressure of the refrigerant compressed in the compressing chamber 17*f* does not act as an internal pressure directly upon the partition wall member 14 and the site of the housing 12 covering the outer peripheral portion of the cylinder. Therefore, the strength of the partition wall member 14 and the site of the housing covering the outer peripheral portion of the cylinder can be relatively enhanced, without increasing the thicknesses of them.

The refrigerant to be compressed is guided to the compressing chamber 17*f* from the suction chamber 15 through the suction inlet 24 opened in the peripheral wall of the cylinder via the suction passage 26 formed along the outer periphery of the cylinder (22, 23*a* and 23*b*). Thus, the low-pressure path including the suction passage 26 can be relatively easily and accurately separated from the high-pressure path including the discharge passage 27. Consequently, internal leakage of the compressed refrigerant can be assuredly prevented by the relatively simple construction.

Therefore, according to the gas compressor 10 of the present invention, high discharge pressure as the internal pressure can be prevented from being applied to the housing 12 at the outer peripheral portion of the cylinder (22, 23*a* and 23*b*), and the internal leakage from the high-pressure side to the low-pressure side can be assuredly prevented. Thus, without increasing the weight of the housing 12, the housing can be made compact and the internal leakage can be assuredly prevented.

The vane rotary type gas-compressing mechanism is shown as the gas-compressing mechanism 17 by way of example in the above-mentioned embodiment. As other gas-compressing mechanism, a scroll type gas-compressing mechanism or another gas-compressing mechanism can be employed. In addition, a variety of electric motors may be employed besides the above-mentioned multi-phase brushless DC motor. Furthermore, the rotary force of the engine can be used as a power source for the gas-compressing mechanism. As the refrigerant, a non-$CO_2$ gas type refrigerant such as R134a may be used.

What is claimed is:

1. A gas compressor, comprising:

a housing formed with a suction port and a discharge port, a partition wall member disposed in the housing and configured to define a suction chamber communicating with the suction port, and a gas-compressing mechanism housed in the housing on a side of the housing opposite to the suction chamber and adapted to compress a gas sucked through the suction port and to discharge the compressed gas through the discharge port, said gas-compressing mechanism comprising a cylinder, said cylinder including a wall which defines a cylinder chamber having a circular or elliptical cross-sectional shape, said cylinder being provided with a suction inlet for sucking the gas to be compressed into the cylinder chamber and a discharge outlet adapted for discharging the compressed gas from the cylinder chamber, said suction inlet and said discharge outlet being opened in a peripheral wall of the cylinder chamber, a discharge passage extending along a center axis of the cylinder chamber, a suction passage formed in the partition wall member along an outer periphery of the discharge passage and including a first passage portion and a second passage portion, wherein the suction passage is provided in a lower portion of the partition wall member, said suction inlet communicating with the suction port via the suction passage, said discharge outlet communicating with a peripheral wall of the discharge passage and communicating with the discharge port via the discharge passage, said suction inlet communicating with the cylinder chamber, said discharge outlet communicating with the cylinder chamber, wherein said discharge passage, which communicates with the discharge outlet, is provided in the cylinder, wherein said discharge passage is formed completely within the wall of the cylinder so that the discharge passage extends through the cylinder from one end of the cylinder to another end thereof along a central axis of the cylinder chamber.

2. The gas compressor set forth in claim 1, wherein said gas-compressing mechanism is a vane rotary type gas-compressing mechanism comprising the cylinder, a rotor rotatably arranged inside the cylinder chamber of the cylinder and having a plurality of vanes, said plurality of the vanes being adapted for dividing the cylinder chamber into a plurality of compressing chambers in a peripheral direction of the cylindrical chamber, and a volume of each of the compressing chambers increasing or decreasing with rotation of the rotor.

3. The gas compressor set forth in claim 2, wherein said cylinder comprises a cylinder member having opposite ends opened and adapted to define a hollow space for said cylinder chamber, and end wall members closing the opposite ends of the cylinder member, respectively, the suction inlet and the discharge outlet are formed in the cylinder member such that the suction inlet and the discharge outlet are opened in a peripheral wall of the cylinder member, said suction passage is formed along an outer periphery of the cylinder member, and said discharge outlet extends inside a thick portion of the cylinder member from one end to the other of the cylinder member.

4. The gas compressor set forth in claim 3, wherein said suction passage comprises the first passage portion extending from the suction chamber communicating with the suction port to under the cylinder member and the second passage portion comprises an annular passage portion defined by a recessed groove along the outer peripheral face, connected with the first passage portion and communicating with the suction inlet.

5. The gas compressor set forth in claim 4, which comprises an electric motor arranged in said suction chamber and adapted to drive the compressing mechanism.

6. The gas compressor set forth in claim 5, wherein the partition wall member is arranged for separating the gas-compressing mechanism from the suction chamber, a rotary shaft of the electric motor is connected to the rotor of the vane rotary type gas-compressing mechanism through the partition wall member, and the first passage portion is formed in said partition wall member.

7. The gas compressor set forth in claim 6, wherein the partition wall member is formed at one surface thereof facing the gas-compressing mechanism with a recessed portion, the cylinder member and a front-side block of the gas-compressing mechanism are received in the recessed portion such that a joint interface between the cylinder member and a rear-side block is in coincidence with said one surface where the recessed portion of the partition wall member is opened.

* * * * *